US005939228A

United States Patent [19]

Tashiro et al.

[11] Patent Number: 5,939,228

[45] **Date of Patent: *Aug. 17, 1999**

[54] DIRECT DRAWING TYPE LITHOGRAPHIC PRINTING PLATE PRECURSOR

[75] Inventors: Hiroshi Tashiro; Seishi Kasai; Eiichi Kato, all of Shizuoka, Japan

[73] Assignee: Fuji Photo Film Co., Ltd., Kanagawa, Japan

[ * ] Notice: This patent issued on a continued prosecution application filed under 37 CFR 1.53(d), and is subject to the twenty year patent term provisions of 35 U.S.C. 154(a)(2).

This patent is subject to a terminal disclaimer.

[21] Appl. No.: 08/787,584

[22] Filed: Jan. 22, 1997

[30] Foreign Application Priority Data

Jan. 23, 1996 [JP] Japan ..... 8-009445

[51] Int. Cl.[6] ..... G03G 5/087

[52] U.S. Cl. ..... 430/49; 101/401.1; 428/148; 428/689

[58] Field of Search ..... 430/49; 101/401.1; 428/148, 689

[56] References Cited

U.S. PATENT DOCUMENTS

| | | | |
|---|---|---|---|
| 5,041,348 | 8/1991 | Kato et al. | 430/49 |
| 5,049,463 | 9/1991 | Kato et al. | 430/49 |
| 5,077,165 | 12/1991 | Kato et al. | 430/89 |
| 5,501,929 | 3/1996 | Kato et al. | 430/49 |
| 5,589,308 | 12/1996 | Kato et al. | 430/49 |
| 5,597,672 | 1/1997 | Kato | 430/49 |

*Primary Examiner*—Nam Nguyen
*Assistant Examiner*—Steven H. Ver Steeg
*Attorney, Agent, or Firm*—McAulay Nissan Goldberg Kiel & Hand, LLP

[57] ABSTRACT

A direct drawing type lithographic printing plate precursor comprising a water-resistant support having provided thereon an image-receiving layer, wherein the image-receiving layer is formed by film coating a dispersion prepared by wet dispersion processing, with a dispersion medium of a nonaqueous solvent, a mixture comprising at least dry zinc oxide, a binder resin and an organic compound which is soluble in the dispersion medium and contains at least one acid group selected from the group consisting of —$CO_2H$, —$SO_3H$ and —$PO_3H_2$, adding a water-soluble low molecular weight organic compound containing at least two or more —$PO_3H_2$ groups, which can form a chelate compound with a zinc ion, and further effecting wet dispersion processing.

4 Claims, No Drawings

DIRECT DRAWING TYPE LITHOGRAPHIC PRINTING PLATE PRECURSOR

FIELD OF THE INVENTION

The present invention relates to a direct drawing type lithographic printing plate precursor and, more specifically, to a direct drawing type lithographic printing plate precursor suitable for light printing, i.e., for use in printing of a relatively small number of sheets (small-size printing).

BACKGROUND OF THE INVENTION

A direct drawing type lithographic printing plate precursor comprising a support having provided thereon an image-receiving layer is now widely used as an office printing plate precursor. For making such a printing plate precursor, that is, for forming images, a method of handwriting images on an image-receiving layer using oil ink, a method of printing with a typewriter, by the ink jet system or the transfer type heat-sensitive system is, in general, adopted. In addition, a method of transferring and fixing the toner image, formed on a photoreceptor through processes of charge, exposure and development using a plain paper copier (PPC), on an image-receiving layer of the printing plate precursor has begun to be used in recent years. In either case, the printing plate precursor after image forming is surface-treated with a desensitizing solution (a so-called etching solution) and a non-image area is desensitized and the resulting printing plate is used as a lithographic printing plate.

In conventional direct drawing type lithographic printing plate precursors, zinc oxide is used as the inorganic pigment in an image-receiving layer. In a direct drawing type lithographic printing plate precursor of a system in which the non-image area after image formation is desensitization-treated and used as a printing plate, in particular, when the printing plate is used in an electrostatic image transfer system, sufficiently transferring a toner image to a printing plate precursor and inhibiting printing smearing as well have been examined using, as zinc oxide, the zinc oxide produced by a wet system, further, using the zinc oxide produced by a wet system in combination with the zinc oxide produced by a dry system (JP-A-5-246166 and JP-A-5-254267 (the term "JP-A" as used herein means an "unexamined published Japanese patent application")), or using zinc oxide containing a small amount of a ferrocyanate group (JP-A-6-72058).

However, there has been a problem in the thus-produced conventional printing plates such that if the addition amount of a waterproofing agent is increased or a hydrophobic resin is used to heighten hydrophobicity for improving the press life, the press life is improved but hydrophilicity is reduced and printing smearing is generated, while when the hydrophilicity is improved, the water-resistanting capability is deteriorated and the press life is lowered.

In particular, there has been a drawback such that in a use atmosphere of high temperature of 30° C. or more, the surface of a printing plate is dissolved in a fountain solution used for offset printing and the press life is lowered and printing smearing is generated. Further, in the case of direct drawing type lithographic printing, since an image area is imaged on an image-receiving layer using oil ink and the like, if adhesive property of the image-receiving layer of the printing plate precursor to the oil ink is not good, even if the hydrophilicity of a non-image area is sufficient and printing smearing as described above is not generated, the oil ink on the image area is dropped out during printing, as a result, press life is deteriorated. This problem has not yet been sufficiently solved up to date.

Moreover, in the recent copied image formation of high degree of resolution using a fine dry toner by an electrophotographic system, for example, in imaging by electrostatic image transfer with a laser printer, etc., to an image-receiving layer, it has been desired that the prevention of stain of the background of a non-image area after transferring should be compatible with the image reproducibility of an image area and printed matters having sharp images and with no stain of a background can be obtained.

SUMMARY OF THE INVENTION

The present invention is to improve the above-described problems in conventional direct drawing type lithographic printing plate precursors.

An object of the present invention is to provide a direct drawing type lithographic printing plate precursor excellent in desensitization which does not generate not only the uniform stain on the entire surface of a background but also dot-like background stain as an offset printing plate precursor.

Another object of the present invention is to provide a direct drawing type lithographic printing plate precursor by which printed matters having sharp images and with no printing smearing can be obtained even by imaging from an electrophotographic copying machine by electrostatic image transfer.

The above objects of the present invention have been attained by the following means:

A direct drawing type lithographic printing plate precursor comprising a water-resistant support having provided thereon an image-receiving layer, wherein the image-receiving layer is formed by film coating a dispersion prepared by:

wet dispersion processing, with a dispersion medium of a nonaqueous solvent, a mixture comprising at least dry zinc oxide, a binder resin and an organic compound which is soluble in the dispersion medium and contains at least one acid group selected from the group consisting of $—CO_2H$, $—SO_3H$ and $—PO_3H_2$ (hereinafter referred to as "Compound (A)"), then adding a water-soluble low molecular weight organic compound containing at least two or more $—PO_3H_2$ groups in the organic molecule, which can form a chelate compound with a zinc ion (hereinafter referred to as "Compound (P)"), and further effecting wet dispersion processing.

DETAILED DESCRIPTION OF THE INVENTION

The image-receiving layer of the direct drawing type lithographic printing plate precursor according to the present invention contains at least dry zinc oxide (hereinafter sometimes abbreviated to "zinc oxide"), a binder resin, Compound (A) and Compound (P).

As described above, a mixture containing at least zinc oxide, a binder resin and Compound (A) is in the first place wet dispersed with a nonaqueous dispersion medium (first dispersion processing) to disperse zinc oxide in fine grain dispersion having comparatively uniform grain size distribution.

Zinc oxide can be rapidly and finely dispersed by the dispersion processing due to the coexistence of Compound (A).

This dispersion is further dispersed after the addition of a prescribed amount of Compound (P), the agglomeration of the zinc oxide grains is adjusted (second dispersion processing) to obtain a dispersion for coating. The dispersion is coated on a water-resistant support and dried to form a film.

It is preferred that Compound (P) is added to the dispersion in the form of a solution prepared by dissolving Compound (P) in water or a mixed solvent composed of water and a water-soluble solvent and second dispersing is effected in an emulsified system of heterogeneous phase.

In the second wet dispersion processing, zinc ions are formed by the interface reaction of the surfaces of the zinc oxide fine grains formed in the first dispersion processing with the protons, these zinc ions rapidly react with Compound (P) to form chelate compounds, these chelate compounds are rapidly precipitated and fixed on the surfaces of the zinc oxide fine grains due to the insolubility in the dispersion medium used for the first dispersion processing, and the surfaces of the zinc oxide fine grains are chemically modified to a hydrophilic atmosphere.

Further, the chemically modified zinc oxide grains become a state of dispersion in the dispersion medium with forming almost homogeneous agglomerations of grains, and a film having appropriate concavities and convexities densely distributed is presumably manifested when an image-receiving layer is formed.

As mentioned above, the image-receiving layer according to the present invention contains Compound (A) and Compound (P) in combination to control the shape of the surface of the grains to a specific state, thereby providing a direct drawing type lithographic printing plate precursor capable of providing good printed matters.

The image-receiving layer of the direct drawing type lithographic printing plate precursor of the present invention is preferably provided on the highly smooth surface of a water-resistant support having Bekk smoothness of 900 to 3,000 (sec./10 cc).

Bekk smoothness used herein is a value expressing smoothness of paper, which can be measured by a Bekk smoothness tester as described in JIS P 8119. A Bekk smoothness tester is an apparatus consisting of a highly smoothly finished circular glass plate having a hole at the center, a test piece is pressed to the plate at a constant pressure (1 kg/cm$^2$) and the time required for a definite amount of air (10 cc) to pass between the glass face and the paper under reduced pressure is measured.

The foregoing smoothness is preferably from 1,000 to 3,000 (sec./10 cc). "The highly smooth surface of a water-resistant support" in the present invention is the surface on which an image-receiving layer is coated directly, for example, when an underlayer or an overcoat layer, which is described later, is provided on the support, highly smooth surface means the surface of the underlayer or the overcoat layer.

The surface state of the image-receiving layer adjusted as described above can be sufficiently retained without being affected by the unevenness of the surface of the support and the further improvement of the image quality becomes possible. Moreover, when a printing plate precursor is made using a laser printer or a heat-sensitive printer, if printer conditions such as the adhered amount of ink or the fixing condition are changed, printed matters of stable and sharp images with no fog can be obtained.

Further, when the desensitized printing plate is produced and used for printing, the printing plate according to the present invention can provide superb printed matters having image areas excellent in the reproducibility of fine lines and fine characters and in the uniformity of solid areas and having less background stain due to adhesion of ink, which offer practically no problem.

A printing plate precursor which can provide a sharp image and no generation of fog in the non-image area can be obtained according to the present invention as the surface of the image-receiving layer is maintained in a state in which coarse convexities are hardly present and appropriate sizes of concavities and convexities are densely formed.

The image-receiving layer according to the present invention is described below.

Any commercially available dry type zinc oxide can be used in the present invention such as zinc oxide and zinc flower as described in Nihon Ganryo Gijutsu Kyokai Ed., *Pigment Handbook-New Edition,* page 319, published by Seibundo Co. (1968).

With respect to dry zinc oxides, there is a French method (an indirect method) and an American method (a direct method) as a dry system depending on the starting material and the production method, e.g., those commercially available from Seido Kagaku Kogyo K.K., Sakai Chemical Industry Co., Ltd., Hakusui Chemical Industries, Ltd., Honjo Chemical K.K., Toho Zinc Co., Ltd., Mitsui Mining & Smelting Co., Ltd., etc., can be cited. The dry zinc oxides preferably comprise granulates having an average particle size of 0.1 to 0.7 $\mu$m.

The non-aqueous solvent which can be used as a dispersion medium in the first dispersion processing include any known non-aqueous solvent as long as a binder resin and zinc oxide can be dispersed therein and the resulting solution can be coated on a support and dried. The solvent may be used as a mixture of two or more thereof.

It is preferred that the solvent has a boiling point of 200° C. or less, more preferably 150° C. or less. As the main solvent for the dispersion medium, an organic solvent having a solution parameter (an SP value) of 8.0 to 10.0 and a boiling point of 200° C. or less can be preferably used.

Examples of such solvents include aromatic hydrocarbons (e.g., benzene, toluene, ethylbenzene, isopropylbenzene, xylene), halogenated hydrocarbons (e.g., methylene chloride, chloroform, methylchloroform), ketones (e.g., methyl ethyl ketone, methyl propyl ketone, methyl butyl ketone, diethyl ketone), aliphatic carboxylic acid esters (e.g., alkyl esters of formic acid, acetic acid, propionic acid, butyric acid (as alkyl group, a methyl group, an ethyl group, a propyl group, a butyl group, a pentyl group is exemplified)), and ethers (e.g., methyl propyl ether, dipropyl ether, dibutyl ether, ethyl propyl ether, ethyl butyl ether, ethylene glycol dimethyl ether, ethylene glycol diethyl, ether, tetrahydrofuran, methylfuran, tetrahydropyran, diethyl acetal, anisole, ethyl phenyl ether).

As the water-soluble solvent which can be used in combination with water in adding Compound (P), any water-soluble solvents having a boiling point of 200° C. or less, preferably 150° C. or less can be used. Ths solvent may be used in admixture of two or more. It is preferred to use a water-soluble solvent having a solubility in water (at 25° C.) of 30% or more, more preferably 50% or more.

Compound (A) for use in the present invention is a low molecular weight organic compound containing at least one acid group selected from the group consisting of —$CO_2H$, —$SO_3H$ and —$PO_3H_2$, and is a molecule soluble in the above-described nonaqueous dispersion medium used for the first dispersion processing.

The molecular weight of Compound (A) is generally from 100 to 1,000, preferably from 150 to 700.

It is preferred that 0.005 g or more, more preferably 0.01 g or more of Compound (A) can dissolve in 100 g of a nonaqueous dispersion medium for the image-receiving layer (at 25° C.).

Still more preferably, 0.01 g or more of Compound (A) can dissolve in 100 g of a mixed solvent of toluene/methanol of 80/20 by weight ratio (at 25° C.).

Compound (A) is used preferably in an amount of from $1\times10^{-5}$ to $1\times10^{-2}$ mol, more preferably from $1\times10^{-4}$ to $5\times10^{-3}$ mol, per 100 g of the zinc oxide.

When Compound (A) is wet dispersed along with zinc oxide and a binder resin, zinc oxide grains can be rapidly finely grained and a coated film having strength enough to prevent from being injured when used as a printing plate can be obtained.

Preferred Compound (A) is a compound which satisfies the above-described physical properties and, as well, has (organic/inorganic) value ratio based on the organic conceptual schema (Atsushi Fujita, *Kagaku no Ryoiki* 11 (*Region of Chemistry* 11), No. 10, pp. 719 to 725 (1957) (abbreviated to O/I value) of from 0.40 to 2.1, more preferably from 0.45 to 1.8.

The improvement of the dispersibility of zinc oxide grains and the maintenance of the water retentivity at the non-image area after desensitization treatment (that is, the prevention of the stain due to the adhesion of ink) can be satisfied at the same time.

Preferably, Compound (A) is a compound having an O/I value ratio of from 0.40 to 2.1 and comprising an aliphatic molecule, an alicyclic molecule or an aromatic molecule having at least one acid group selected from the group consisting of $—CO_2H$, $—SO_3H$ and $—PO_3H_2$.

Examples of the aliphatic molecules include alkanes having from 5 to 10 carbon atoms, which may be substituted, (e.g., pentane, heptane, octane, nonane, decane), and alkenes having from 3 to 10 carbon atoms, which may be substituted, (e.g., propene, butene, pentene, hexene, octene).

As other substituents than the specific acid groups which can be contained in the aliphatic molecules, there can be cited, for example, a halogen atom (e.g., fluorine, chlorine, bromine, iodine), an alkyl group having from 1 to 3 carbon atoms, an alkoxyl group having from 1 to 4 carbon atoms (e.g., methoxy, ethoxy, propoxy, butoxy), a cyano group, a formyl group, an alkyl-substituted carboxylic acid ester group having from 1 to 4 carbon atoms (e.g., methoxycarbonyl, ethoxycarbonyl), an alkylthiol group (e.g., methylthiol, ethylthiol), an acyl group (e.g., acetyl, propionyl), an alkanesulfonyl group (e.g., methanesulfonyl), a carbonamido group (e.g., N-methyl product, N,N-dimethyl product, N-ethyl product, N,N-diethyl product, N-methylol product, N-(2-hydroxyethyl) product), and a sulfonamido group (as N-substitution products, the same substitution products as in the carboxyamido products can be cited).

Further, examples of the aliphatic molecules include compounds in which a linking group constituting the backbone chain together with a methylene group is constituted of the group selected from the group consisting of $$—O—,\quad —S—,\quad —\underset{\underset{O}{\|}}{C}—,\quad —\underset{\underset{R_1}{|}}{N}—,$$

$$—OCO—,\quad —COO—,\quad —SO_2—,$$

-continued $$—NHCOO—,\quad —NHCONH—,\quad —\underset{\underset{R^2}{|}}{CON}—,$$

$$—SO_2\underset{\underset{R_3}{|}}{N}—,\quad —\overset{\overset{R_4}{|}}{\underset{\underset{R_4}{|}}{Si}}—,$$

and the total number of atoms which constitute the backbone chain moiety is from 3 to 18; wherein $R_1$, $R_2$ and $R_3$ each represents a hydrogen atom or an aliphatic group having from 1 to 7 carbon atoms which may be substituted (e.g., methyl, ethyl, propyl, butyl, pentyl, propenyl, butenyl, hexenyl, cyclopentyl, benzyl, 2-chloroethyl, 3-methoxypropyl, 2-hydroxyethyl, 2-cyanoethyl); and $R_4$ and $R_5$ each represents an aliphatic group having from 1 to 7 carbon atoms, which may be substituted.

Examples of the alicyclic molecules include compounds consisting of from 5 to 12 carbon atoms which may be substituted (e.g., cyclopentane, cyclohexane, cyclohexene, cyclohexadiene, norbornane, norbornene, 2-norbornanone, adamantane).

Examples of the aromatic molecules include a benzene ring, a naphthalene ring, a naphthoquinone ring, an anthracene ring, an anthraquinone ring, etc.

In addition to the above, a heterocyclic molecule having at least one hetero atom, e.g., a nitrogen atom, an oxygen atom, a sulfur atom, or the like (e.g., pyran, furan, pyridine, pyrimidine, piperidine, morpholine, oxazole, thiazole, thiophene, benzothiophene, pyrrole, imidazole, pyrazine, indole, quinoline, carbazole, benzothiazole, pyrazolone, barbituric acid, imidazole, imidazolone) can be cited.

The alicyclic molecules and aromatic molecules (including heterocyclic molecules) may have other substituent(s) than the specific acid groups, and examples of the substituent include those exemplified above with respect to the aliphatic molecules.

It is preferred that Compound (A) has the solubility in the dispersion medium and the (organic/inorganic) value ratio each falling within the range described above.

The water-soluble organic compound (Compound (P)) containing at least two or more $—PO_3H_2$ groups in the organic molecule, which can form a chelate compound with a zinc ion, is described below.

The solubility in water (at 25° C.) of Compound (P) is preferably at least 0.5 wt % or more, more preferably 5 wt % or more, and when Compound (P) forms a chelate compound with a zinc ion, the solubility in water (at 25° C.) of the chelate compound is preferably 15 wt % or less, more preferably 10 wt % or less. The molecular weight of Compound (P) is generally from 200 to 1,500, preferably from 210 to 1,000.

Specific examples of the low molecular weight compound (Compound (P)) include inositol hexaphosphate (phytic acid in another name), inositol hexaphosphate derivatives in which a hydroxyl group at the 1- or 4-position is inactivated as disclosed in JP-A-53-83806, JP-A-53-83807, JP-A-53-109701, JP-A-53-127002, JP-A-53-127003 and JP-A-54-44901, and a compound containing at least one polar group represented by the following formula (Ia) and/or (Ib), more preferably a compound represented by the following formula (II), (III), (IV), (V), (VI) or (VII) containing 1 to 3 polar groups represented by formula (Ia) and/or (Ib):

(Ia)

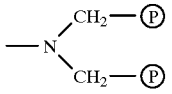

(Ib)

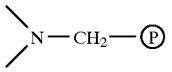

wherein Ⓟ represents $—PO_3H_2$ or $—OPO_3H_2$ and these groups may form a salt.

(II)

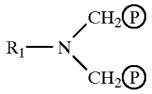

(III)

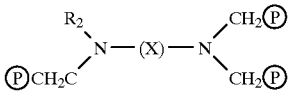

(IV)

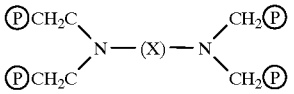

(V)

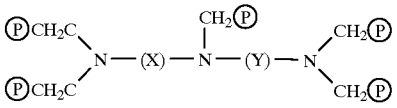

(VI)

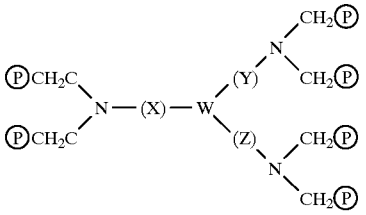

(VII)

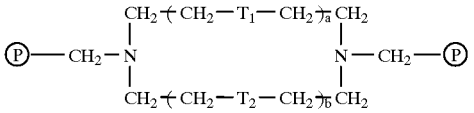

wherein Ⓟ represents the same meaning as in formulae (Ia) and (Ib).

In formulae (II) to (VII), $R_1$, $R_2$, X, Y and Z, each may have substituent(s) and represents an organic residue which may form a ring by connecting with each other. W represents a hetero atom such as a nitrogen atom, methine carbon

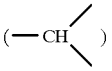

or a cyclic organic residue.

$R_1$ and $R_2$ each preferably represents an alkyl group having from 1 to 18 carbon atoms, a cycloalkyl group, an alkenyl group, or an aralkyl group, each of which may be substituted with substituent(s), and examples of the substituent include an alkoxyl group ($—OR_3$), a sulfido group ($—SR_3$), an amino group

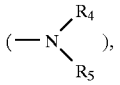

a halogen atom, a cyano group, a nitro group, a hydroxyl group, a carboxyl group, a sulfonic acid group, a sulfonamido group, an amido group and an ester group.

X, Y and Z each preferably represents a linking group, which may have substituent(s). Examples of the linking group include an alkylene group having from 1 to 18 carbon atoms, a cycloalkylene group, an alkenylene group, an aralkylene group, a polyether group, a polyamine group, and examples of the substituent include an alkoxyl group ($—OR_3$), a sulfido group ($—SR_3$), an amino group

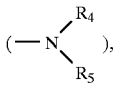

a halogen atom, a cyano group, a nitro group, a hydroxyl group, a carboxyl group, a sulfonic acid group, a sulfonamido group, an amido group and an ester group.

$R_3$ represents an aliphatic group having from 1 to 18 carbon atoms such as those described with respect to $R_1$, and $R_4$ and $R_5$ each represents a hydrogen atom, an aliphatic group having from 1 to 18 carbon atoms such as those described with respect to $R_1$, or an aliphatic ring capable of being connected together.

W preferably represents a nitrogen atom, methine carbon

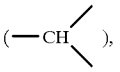

a cycloalkyl group, an aralkyl group or an aryl group.

$R_1$ and $R_2$ each more preferably represents a hydrogen atom, an alkyl group having from 1 to 14 carbon atoms which may be substituted (e.g., methyl, ethyl, propyl, isopropyl, butyl, isobutyl, heptyl, hexyl, octyl, decyl, dodecyl, hexadecyl, octadecyl, 2-hydroxyethyl, 2-hydroxypropyl, 3-hydroxypropyl, 4-hydroxybutyl, 2-hydroxybutyl, 2-methoxyethyl, 2-butoxyethyl, 2-ethoxyethyl, 4-methoxybutyl, methylthioethyl, methylthiobutyl, 2-aminoethyl, N,N'-dimethylaminoethyl, piperidinomethyl, pyrrolidinoethyl, 2-chloroethyl, 2-chlorobutyl, 2-bromoethyl, 2-cyanoethyl, 4-cyanobutyl, 2-carboxyethyl, carboxymethyl, 3-carboxypropyl, 3-morpholinopropyl, 2-morpholinoethyl, 2-sulfoethyl, 2-piperidinoethyl, amidomethyl, thioethyl, imidazolididoethyl, sulfonamidoethyl);

an alkenyl group which may be substituted (e.g., 2-methyl-1-propenyl, 2-butenyl, 2-pentenyl, 3-methyl-2-pentenyl, 1-pentenyl, 1-hexenyl, 2-hexenyl, 4-methyl-2-hexenyl, vinyl, 2-propenyl, 3-butenyl);

an aralkyl group which may be substituted (e.g., benzyl, phenethyl, 3-phenylpropyl, naphthylmethyl, 2-naphthylethyl, chlorobenzyl, bromobenzyl, methylbenzyl, ethylbenzyl, methoxybenzyl, dimethylbenzyl, dimethoxybenzyl, cyanobenzyl, nitrobenzyl, hydroxybenzyl, carboxybenzyl, dimethylaminobenzyl, naphthyl, adamantyl, amidobenzyl, sulfonamidobenzyl); or a cycloalkyl group which may be substituted (e.g., cyclopropyl, cyclobutyl, cyclopentyl, cyclohexyl, cycloheptyl, 4-methylcyclohexyl, 4-chlorocyclohexyl, 4-methoxycyclohexyl, 4-cyanocyclohexyl).

X, Y and Z each more preferably represents an alkylene linking group having from 1 to 14 carbon atoms which may be substituted (e.g., methylene, ethylene, propylene, butylene, 1-methylethylene, 1-methylpropylene, 2-methylbutylene, hexylene, 1-hydroxybutylene, 2-hydroxybutylene, 2-hydroxypropylene, 1-carboxybutylene, 2-carboxybutylene);

an alkenylene linking group which may be substituted (e.g., 2-methyl-1-propenylene, 2-butenylene, 2-pentenylene, 2-hexenylene);

an aralkylene linking group which may be substituted (e.g., p-xylylene, m-xylylene, o-xylylene, 2,5-dimethylxylylene, 2,3,5,6-tetramethylxylylene, 2,5-di(dimethylamino)xylylene, 2,5-dimorpholinoxylylene, 2-methylxylylene, 2-ethylxylylene, naphthylene, adamantylene, 2,5-dimethoxyxylylene, piperadinopropylene, 2-butylxylylene, 2,5-dibutylxylylene);

a cycloalkylene linking group which may be substituted (e.g., 1,4-cyclohexylene, 1,3-cyclobutylene, cyclopropylene, 1,3-cyclopentanylene, 1,2-cyclohexylene, 1,3-bis(methylene)cyclohexane, 1,4-bis(methylene)cyclohexane, 1,3-bis(methylene)cyclopentane, 1,2-cyclohexylene);

polyethers (e.g., diethylene oxide, dipropylene oxide, dibutylene oxide, tetraethylene oxide); or polyamines (e.g., diethyleneimine, tetraethyleneimine).

In formula (VII), $T_1$ and $T_2$ each represents —NH—,

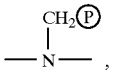

—O— or —S—, wherein Ⓟ represents the same meaning as in formulae (Ia) and (Ib); and a and b each represents an integer of from 1 to 3.

Compound (P) containing these polar groups represented by formula (Ia) or (Ib) may be either of Compound (P) per se or the salt thereof, and examples of the salts include inorganic salt (e.g., salts of lithium, sodium, potassium), ammonium salt, or salt with organic base (e.g., primary amine, secondary amine, tertiary amine (as a hydrocarbon group, a methyl group, an ethyl group, a propyl group, a butyl group, a pentyl group, a hexyl group, a heptyl group, an octyl group, a decyl group, a dodecyl group, a tridecyl group, a tetradecyl group, a hexadecyl group, an octadecyl group, a cyclohexyl group, a cyclooctyl group, a benzyl group, or a phenethyl group can be cited, and these hydrocarbon groups may have substituents such as a hydroxyl group, a halogen atom, a cyano group, an alkoxyl group, or an amido group), anilines (e.g., aniline, N-methylaniline, N,N-dimethylaniline, N-ethylaniline, N-butylaniline, N-methyl-N-butylaniline), or a hetero atom-containing cyclic nitrogen compound (e.g., pyridine, morpholine, piperazine, pyridine)).

These salt compounds may be a compound in which a part of or all of the acid group in the molecule may be salt, and the salts formed may be the same or different.

Specific examples of the compounds represented by formulae (II) to (VII) are shown below, but the present invention is not limited thereto.

In specific examples, Ⓟ represents

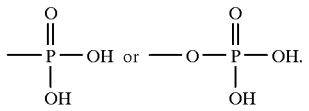

(1) $R_1$—N($CH_2$—Ⓟ)$_2$ $R_1$: —$C_nH_{2n+1}$ (n=an integer of from 1 to 12) —$C_mH_{2m}$ (m=an integer of from 2 to 10)

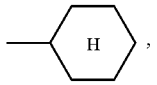

(2) $X_1(CH_2)_l$N($CH_2$—Ⓟ)$_2$ $X_1$: —COOH, —OH, —SH, —$SO_3H$, —$SO_2NH_2$, —$CONH_2$, —$OC_nH_{2n+1}$, l: an integer of from 1 to 4

(3)

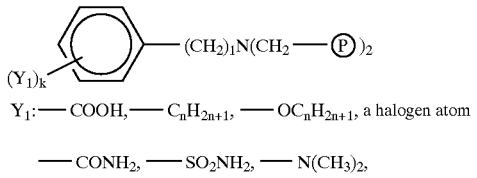

$Y_1$: —COOH, —$C_nH_{2n+1}$, —$OC_nH_{2n+1}$, a halogen atom

—$CONH_2$, —$SO_2NH_2$, —$N(CH_3)_2$, (4)

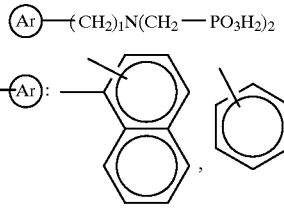

(5)

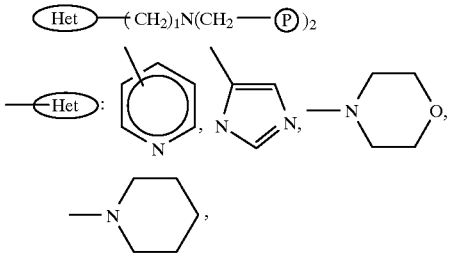

(6)

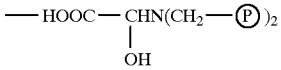

(7)

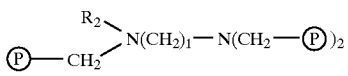

$R_2$: —$C_nH_{2n+1}$, —$CH_2COOH$, —$(CH_2)_2OH$,

-continued (8)

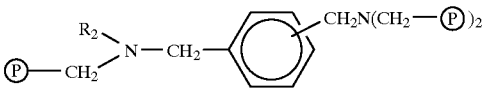

(9)

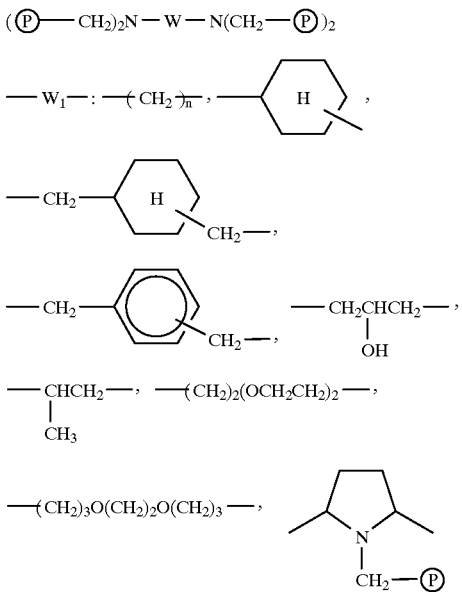

(10)

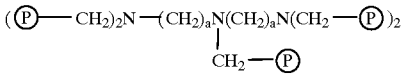

a: an integer of from 2 to 4

(11)

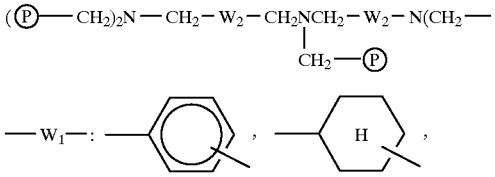

(12)

(13)

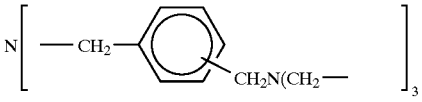

(14)

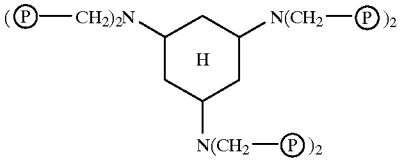

-continued (15)

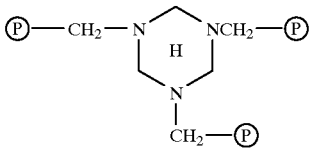

(16)

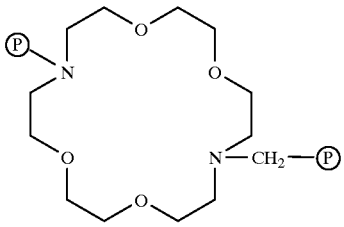

(17)

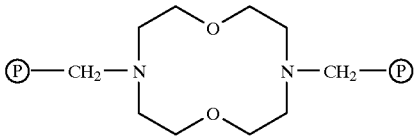

(18)

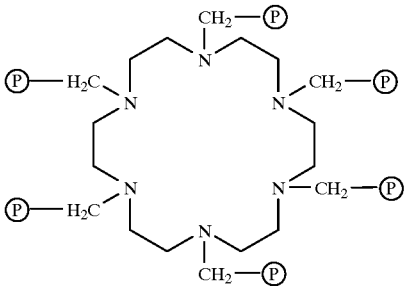

Compound (P) of the present invention can be synthesized by the addition reaction of phosphonic acid to Schiff base, the dehydration condensation reaction of alcohol and orthophosphoric acid, and the condensation reaction of alcohol and phosphorus oxychloride which are described in *Jikken Kagaku Koza* 19 (*Experimental Chemistry Lecture* 19), Maruzen (1957).

The amount of Compound (P) contained in the image-receiving layer of the present invention is preferably from $1.0\times10^{-4}$ to $1.0\times10^{-1}$ mol, more preferably from $1.0\times10^{-4}$ to $5.0\times10^{-2}$ mol, per 100 g of the zinc oxide. This range of the content of Compound (P) is appropriate to obtain a printed matter comprising a sharp image area of a copied image and a non-image area without background stain by reacting with zinc oxide grains in a dispersion processing step, forming a chelate compound and adjusting grains to agglomerate to provide a desired smoothness. Most preferred amount of Compound (P) is from $2.0\times10^{-4}$ to $4.0\times10^{-2}$ mol per 100 g of the zinc oxide.

Any conventionally known binder resins can be used as the binder resin for the image-receiving layer of the present invention.

The molecular weight of the binder resin for use in the image-receiving layer of the present invention is preferably from $10^3$ to $10^6$, more preferably from $5\times10^3$ to $5\times10^5$. The glass transition temperature of the binder resin is preferably from −10° C. to 120° C., more preferably from 0° C. to 90° C.

Representative examples of such binder resins include water-insoluble resins such as a vinyl chloride/vinyl acetate copolymer, a styrene/butadiene copolymer, a styrene/methacrylate copolymer, a methacrylate copolymer, an acrylate copolymer, a vinyl acetate copolymer, polyvinyl butyral, an alkyd resin, a silicone resin, an epoxy resin, an epoxy ester resin, and a polyester resin. These resins may be used alone or in combination.

Besides the above-described components, the image-receiving layer may contain other constitutional components.

As other components which can be used in the present invention in addition to zinc oxide, inorganic pigment such as kaolin clay, calcium carbonate, barium carbonate, calcium sulfate, barium sulfate, magnesium carbonate, titanium oxide, silica, and alumina can be cited. These other pigments can be in the amount not exceeding 20 parts by weight based on the zinc oxide of the present invention.

Further, for the improvement of the desensitization of the image-receiving layer, resin grains having specific functional groups disclosed in JP-A-4-201387, JP-A-4-223196, JP-A-4-319491, JP-A-5-58071, JP-A-4-353495 and JP-A-5-119545 may be contained.

By using these other inorganic pigments or resin grains, desensitization (hydrophilicity) of a non-image area by desensitization treatment can be conducted sufficiently, background stain of printed matters can be prevented, further, an image area (toner components) can adhere to an image-receiving layer sufficiently, and if the number of printed sheets is increased, sufficient press life can be obtained without generating defects of images.

The ratio of a pigment (including zinc oxide) to a binder resin in an image-receiving layer is, in general, from 10 to 25 parts by weight of a binder resin, preferably from 13 to 22 parts by weight, per 100 parts by weight of a pigment. The effect of the present invention can be manifested effectively within this range, the film strength during printing can be retained and high hydrophilicity at the time of desensitization treatment can be maintained as well.

In addition, a crosslinking agent may be added to an image-receiving layer for improving the film strength. In particular, when a water-soluble resin is used as a binder resin, it is preferred to strengthen the film and improve water resisting property by using a crosslinking agent in combination.

Compounds generally used as a crosslinking agent can be used in the present invention. Specifically, the compounds disclosed in Shinzo Yamashita and Tosuke Kaneko, *Crosslinking Agent Handbook,* Taiseisha (1981), and *High Polymer Data Handbook, Fundamental,* edited by The Society of Polymer Science, Japan, Baifukan (1986) can be used.

Examples thereof include organic peroxide, an organic silane compound (e.g., a silane coupling agent such as vinyltrimethoxysilane, vinyltributoxysilane, γ-glycidoxypropyltrimethoxysilane, γ-mercaptopropyltriethoxysilane, γ-aminopropyltriethoxysilane), a polyisocyanate compound (e.g., toluylenediisocyanate, diphenylmethanediisocyanate, triphenylmethanetriisocyanate, polymethylenepolyphenylisocyanate, hexamethylenediisocyanate, isophoronediisocyanate, high molecular polyisocyanate), a polyol compound (e.g., 1,4-butanediol, polyoxypropylene glycol, polyoxyethylene glycol, 1,1,1-trimethylolpropane), a polyamine compound (e.g., ethylenediamine, γ-hydroxypropylated ethylenediamine, phenylenediamine, hexamethylenediamine, N-aminoethylpiperazine, modified aliphatic polyamines), a titanate coupling compound (e.g., tetrabutoxytitanate, tetrachloroepoxytitanate, isopropyltristearoyltitanate), an aluminum coupling compound (e.g., aluminum butylate, aluminum acetylacetate, aluminum oxidooctate(aluminum-tris(acetylacetate)), a polyepoxy group-containing compound and an epoxy resin (e.g., compounds described in Hiroshi Kakiuchi, *New Epoxy Resin,* Shokodo (1985), Kuniyuki Hashimoto, *Epoxy Resin,* Nikkan Kogyo Shinbunsha (1969)), a melamine resin (e.g., compounds described in Ichiro Miwa and Hideo Matsunaga, *Urea·Melamine Resin,* Nikkan Kogyo Shinbunsha (1969)), a poly(meth)acrylate compound (e.g., compounds described in Makoto Ohkawara, Takeo Saegusa, Toshinobu Higashimura, *Oligomer,* Kodansha (1976), Eizo Ohmori, *Functional Acrylic Resin,* Techno System (1985)).

A reaction accelerating agent may be added, if necessary, to accelerate the crosslinking reaction in an image-receiving layer.

As such reaction accelerating agents, when the crosslinking reaction is conducted in the reaction system of forming a chemical bond between functional groups, the examples include organic acids (e.g., acetic acid, propionic acid, butyric acid, benzenesulfonic acid, p-toluenesulfonic acid), phenols (e.g., phenol, chlorophenol, nitrophenol, cyanophenol, bromophenol, naphthol, dichlorophenols), an organic metal compound (e.g., acetylacetonato zirconium salt, acetylacetone zirconium salt, acetylaceto cobalt salt, dilauric acid dibutoxy stannate), a dithiocarbamic acid compound (e.g., diethyldithiocarbamates), a thiuram disulfide compound (e.g., tetramethylthiuram disulfide), and carboxylic anhydride (e.g., phthalic anhydride, maleic anhydride, succinic anhydride, butylsuccinic anhydride, 3,3',4,4'-tetracarboxylic acid benzophenone dianhydride, trimellitic anhydride). When the crosslinking reaction is conducted in a polymerization reaction system, the examples include a polymerization initiator (peroxide and an azobis compound).

A binder resin is preferably cured by light and/or heat after the coating composition for an image-receiving layer is coated. For conducting heat-curing, drying condition is made severer than the conventional drying condition in the production of an image-receiving layer. For example, the drying temperature is made higher and the time longer, or after drying the coated solvent, heat treatment is further conducted. For example, treatment is conducted at 60° C. to 150° C. for 5 to 120 minutes. When the above reaction accelerator is used in combination, the treatment can be carried out moderately.

For curing a specific functional group in the resin by light irradiation, it is effective to adopt a step of irradiation with a chemically active light. As a chemically active light, any of a visible light, an ultraviolet ray, a far ultraviolet ray, an electron beam, an X-ray, a γ-ray, and an α-ray can be used, preferably an ultraviolet ray, and more preferably a light having a wavelength of 310 nm to 500 nm. Low pressure, high pressure or superhigh pressure mercury lamps and halogen lamps are generally used. Light irradiation treatment is, in general, sufficiently conducted at a distance of 5 cm to 50 cm for an irradiation time of from 10 seconds to 10 minutes.

A water-resistant support on which the image-receiving layer of the present invention is provided is described below.

It is preferred that the smoothness of the surface of the side of the support adjacent to the image-receiving layer is adjusted to 900 to 3,000 (sec/10 cc).

Various known methods can be used to adjust the smoothness to the above range. That is, a method of melt-adhering the surface of the substrate with a resin, a method of adjusting Bekk smoothness of the surface of the support by calendering reinforcement by a high smooth heat roller can be used.

As a method of melt-adhering the surface with a resin, coating by the extrusion laminating method is preferably used in the present invention. A support having the desired smoothness can be produced by coating by the extrusion laminating method. The extrusion laminating method is a method of melting a resin, forming the molten resin to film, immediately press-adhering the film on raw paper, cooling to obtain a paper laminated with the film, and various apparatuses therefor are known.

The thickness of the resin layer thus laminated is 10 μm or more in view of the stability of production, preferably from 10 μm to 30 μm.

As the resin for the above purpose, a polyethylene resin, a polypropylene resin, an acrylic resin, a methacrylic resin, an epoxy resin, and copolymers of these resins can be used. Two or more of these resins can be used in combination. A polyethylene resin is preferred above all. Of a polyethylene resin, a mixture of low density polyethylene and high density polyethylene is particularly preferred. Uniformity of the coated film and heat resistance can be ensured by this mixture. When a conductive substance is added to a resin layer, which is described later, conductivity becomes better by the use of this mixture.

As the above low density polyethylene, density: 0.915 to 0.930 g/cc, melt index: 1.0 to 30 g/10 min. is preferred, and as the high density polyethylene, density: 0.940 to 0.970 g/cc, melt index: 1.0 to 30 g/10 min. is preferred. They are preferably blended in a ratio of from 10 to 90 wt % of low density polyethylene and from 90 to 10 wt % of high density polyethylene.

Further, when raw paper is used as a substrate, it is preferred to coat polyethylene derivatives on the raw paper in advance for improving the adhesion between the raw paper and the resin layer, such as an ethylene/vinyl acetate copolymer, an ethylene/acrylic ester copolymer, an ethylene/methacrylic ester copolymer, an ethylene/acrylic acid copolymer, an ethylene/methacrylic acid copolymer, an ethylene/acrylonitrile/acrylic acid copolymer, or an ethylene/acrylonitrile/methacrylic acid copolymer. It is also preferred for the surface of the raw paper to be corona discharge treated in advance. As other methods, surface treatment of the raw paper can be conducted according to the methods disclosed in JP-A-49-24126, JP-A-52-36176, JP-A-52-121683, JP-A-53-2612, JP-A-54-111331 and JP-B-51-25337 (the term "JP-B" as used herein means an "examined Japanese patent publication").

A calendering reinforcement which is cited as other method is conducted, for example, by calender treating a substrate such as paper, described later, or a support having provided thereon an underlayer. Conditions of calendering treatment are arbitrarily controlled according to the compositions of the substrate and underlayer. The kind and combination of rollers such as a metal roller, a resin roller, or a cotton roller, number of stages of calender rollers, pressure of roller nip, temperature of the surface of a roller can be selected arbitrarily.

In the present invention, an underlayer can be provided between a support and an image-receiving layer for the purpose of improving water resisting property and adhesive properties between layers, and a back coat layer (a backing layer) can be provided on the support opposite to the side on which the image-receiving layer is provided for preventing curling. The smoothness of the back coat layer is preferably from 150 to 700 (sec./10 cc).

According to this, a printing plate can be fed to an offset printing machine without dislocation or sliding and accurately set in the machine.

When adjusting the smoothness of the underlayer and the back coat layer of the support respectively, it is preferred to conduct calendering treatment step a plurality of times, such as once treatment is carried out after formation of the underlayer and again calendering treatment is conducted after formation of the back coat layer, alternatively it is preferred to control smoothness by the combination of adjustment of compositions such as the ratio of pigments and grain sizes of the underlayer and the back coat layer, and adjustment of conditions of calendering treatment.

As the support for the printing plate precursor of the present invention, substrates such as wood pulp paper, synthetic pulp paper, mixed paper of wood pulp and synthetic pulp, non-woven fabric, plastic film, fabric, metal sheet, and composite sheets of these can be used as they are. Further, for obtaining the smoothness specified in the present invention and for adjusting water resisting property and other properties, the substrate may be impregnated with a coating solution comprising a hydrophobic resin, a water dispersible resin, a water-soluble resin or a pigment for use in the underlayer and back coat layer, which are described later.

In the present invention, it is preferred to use a substrate having provided thereon an underlayer and a back coat layer to satisfy the printing suitability such as a recording property, water resisting property, durability and the like required of a lithographic printing plate precursor, and to adjust the smoothness to the desired range. Such an underlayer and a back coat layer are formed by coating a coating solution containing a resin and a pigment on a substrate, drying and laminating. Various kinds of resins are selected arbitrarily and used herein. Specific examples thereof include, as hydrophobic resins, e.g., acrylic resins, vinyl chloride resins, styrene resins, styrene/butadiene resins, styrene/acrylic resins, urethane resins, vinylidene chloride resins, and vinyl acetate resins, as hydrophilic resins, e.g., polyvinyl alcohol resins, cellulose derivatives, starch and derivatives thereof, polyacrylamide resins, and styrene/maleic anhydride copolymers.

As pigments, there can be cited clay, kaolin, talc, diatomaceous earth, calcium carbonate, aluminum hydroxide, magnesium hydroxide, titanium oxide, and mica. These pigments are preferably used by selecting grain sizes arbitrarily for attaining the desired smoothness as described above. For example, in an underlayer, where comparatively high smoothness is required, a small grain size and a large grain size are excluded, a pigment having a grain size of 8 μm or less, particularly from 0.5 to 5 μm are preferably used. Since lower smoothness than that of an underlayer is required of a back coat layer, a pigment having a larger grain size, from 0.5 to 10 μm is preferably used. It is preferred to use a pigment in the ratio of from 80 to 150 parts by weight per 100 parts by weight of the resin in an underlayer and from 80 to 200 parts by weight per 100 by weight of the resin in a back coat layer. In addition, it is effective to contain a water-resistanting agent such as a melamine resin and a polyamide epichlorohydrin resin in an underlayer and a back coat layer for acquiring excellent water resisting property.

When imaging is conducted by an electrophotographic system using PPC in which a toner is transferred to a direct drawing type lithographic printing plate precursor by electro-static image transfer, for further reducing the background stain of the printing plate precursor of the present invention, a conductive agent can be added to an image-receiving layer, an underlayer and/or a back coat layer such that the specific volume resistivity of the printing precursor as a whole falls within the range of $10^8$ to $10^{13}\Omega\cdot$cm.

The conductive agent may be inorganic or organic, and may be used alone or two or more of them may be used in combination. Examples of the inorganic agent include, e.g., salts of monovalent metals such as Na, K and Li, salts of polyvalent metals such as Mg, Ca, Ba, Zn, Ti, Co, Ni, Zr, Al and Si, or oxides or ammonium salts. The organic agent may be either of a low molecular weight compound or a high molecular compound, and compounds conventionally used as a conductive agent, an antistatic agent or a surfactant can be cited. For example, known compounds such as a metal soap (e.g., metal salts of organic carboxylic acid, organic sulfonic acid, organic phosphonic acid), a quaternary salt compound (e.g., quaternary ammonium salt, quaternary phosphonium salt), an anionic surfactant, a nonionic surfactant, a cationic surfactant, an alcohol compound (e.g., a crystalline compound such as acetylene-1,2-diol, xylylenediol, bisphenol A) can be cited and they may be used alone or two or more thereof may be mixed arbitrarily.

These conductive agents are used in an amount of from 3 to 40 wt %, preferably from 5 to 20 wt %, based on the amount of the binder resin used in each layer.

For making the direct drawing type lithographic printing plate precursor of the present invention, in general, if necessary, the coating solution containing the composition of an underlayer is coated on one side of a support and dried to form an underlayer, if further necessary, the coating solution containing the composition of a back coat layer is coated on the other side of the support and dried to form a back coat layer, subsequently the coating solution containing the composition of an image-receiving layer is coated and dried to form an image-receiving layer. The coating amount of an image-receiving layer, an underlayer and a back coat layer each is generally from 1 to 30 g/m$^2$, preferably from 6 to 20 g/m$^2$ in terms of dry weight.

The film thickness of the water-resistant support on which an underlayer or a back coat layer is provided is from 90 to 130 $\mu$m, preferably from 100 to 120 $\mu$m. A sharp image with no background stain can be obtained in imaging by an electrophotographic system using PPC, a toner image can be fixed sufficiently, and the defects of a toner image due to the pressure at offset printing or adhesive strength with an ink is not generated.

The production of a printing plate using the direct drawing type lithographic printing plate precursor of the present invention is conducted by forming and fixing images on the direct drawing type lithographic printing plate precursor having the above-described constitution according to known techniques for plate making, then carrying out surface treatment using a desensitizing solution to desensitize a non-image area.

As conventionally known desensitizing solutions for zinc oxide, a cyanide compound-containing treating solution comprising a ferrocyan salt or a ferricyan salt as main components, ammine cobalt complex, phytic acid and derivatives thereof, a cyan-free treating solution comprising guanidine derivatives as primary components, a treating solution comprising inorganic or organic acid which forms chelate with a zinc ion as a primary component, or a treating solution containing a water-soluble polymer are known as this kind of desensitizing treating solutions.

For example, as a cyanide compound-containing treating solution, those disclosed in JP-B-44-9045, JP-B-46-39403, JP-A-52-76101, JP-A-57-107889, and JP-A-54-117201 can be cited.

As a phytic acid-containing treating solution, those disclosed in JP-A-53-83807, JP-A-53-83805, JP-A-58-102102, JP-A-53-109701, JP-A-53-127003, JP-A-54-2803, and JP-A-54-44901 can be cited.

As a treating solution containing a metal complex compound such as cobalt complex, those disclosed in JP-A-53-104301, JP-A-53-140103, JP-A-54-18304, and JP-B-43-28404 can be cited.

As a treating solution containing an inorganic or organic acid, those disclosed in JP-B-39-13702, JP-B-40-10308, JP-B-43-28408, JP-B-40-26124, and JP-A-51-118501 can be cited.

As a guanidine compound-containing treating solution, those disclosed in JP-A-56-111695 can be cited.

As a water-soluble polymer-containing treating solution, those disclosed in JP-A-52-126302, JP-A-52-134501, JP-A-53-49506, JP-A-53-59502, JP-A-53-104302, JP-B-38-9665, JP-B-39-22263, JP-B-40-763, JP-B-40-2202, and JP-A-49-36402 can be cited.

In any desensitization treatments of the above, it is thought that the zinc oxide in the surface layer is ionized and becomes a zinc ion, this ion generates chelating reacting with the compound in the desensitization treating solution which forms chelate and a zinc chelated compound is formed, this chelate compound is deposited in the surface layer and made hydrophilic.

The present invention is described in detail below with reference to the following examples but the present invention is not limited thereto.

EXAMPLE 1

A mixture of 100 g of dry zinc oxide (produced by Seido Kagaku Kogyo K.K.), 10.2 g of binder resin (B-1), 6.8 g of binder resin (B-2) each having the structure shown below, 0.15 g of benzoic acid (A-1) and 155 g of toluene was dispersed using a wet disperser Keddy Mill KDM7-4 type (a product of Rigaku Kogyo K.K.) at a rotating rate of $1\times10^4$ rpm for 20 minutes. Subsequently, a mixed solution of 3 g of a 50% aqueous solution of phytic acid (P-1) and 4 g of methanol was dropwise added to the above dispersion at a rotating rate of $1\times10^3$ rpm over 10 minutes.

The above reaction mixture was further dispersed at a rotating rate of $5\times10^3$ rpm over 20 minutes and a dispersion for an image-receiving layer was obtained.

Binder Resin (B-1)

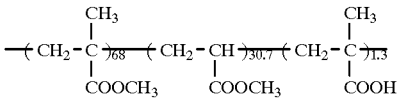

Mw 3.5 × 10$^4$ (ratio by weight)

Binder Resin (B-2)

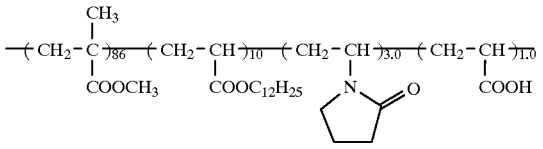

Mw 4 × 10$^4$ (ratio by weight)

The above composition was coated with a wire bar coater on a support of ELP-1 type Master (a trade name, produced by Fuji Photo Film Co., Ltd.), which is used as electrophotographic system lithographic printing plate precursor for light printing, dried at 100° C. for 1 minute to form an image-receiving layer having a coating amount of 8 g/m$^2$ and a direct drawing type lithographic printing plate precursor was obtained.

COMPARATIVE EXAMPLE 1

A mixture comprising all the compositions used in Example 1 (100 g of dry zinc oxide, 10.2 g of binder resin (B-1), 6.8 g of binder resin (B-2), 0.15 g of benzoic acid, 3 g of a 50% aqueous solution of phytic acid, 4 g of methanol, and 155 g of toluene) was dispersed by a disperser used in Example 1 and coated on a support of ELP-1 type master and a direct drawing type lithographic printing plate precursor was obtained.

COMPARATIVE EXAMPLE 2

A direct drawing type lithographic printing plate precursor was produced in the same manner as in Example 1 except for excluding compound (A-1) used in Example 1.

COMPARATIVE EXAMPLE 3

A direct drawing type lithographic printing plate precursor was produced in the same manner as in Example 1 except for excluding compound (P-1) used in Example 1.

COMPARATIVE EXAMPLE 4

A direct drawing type lithographic printing plate precursor was produced in the same manner as in Example 1 except for excluding compounds (A-1) and (P-1) used in Example 1.

However, dispersion conditions in Comparative Examples 1 to 4 were adjusted to reach the same Bekk smoothness as the image-receiving layer in Example 1.

Using each of the thus-obtained printing plate precursors of Example 1 and Comparative Examples 1 to 4, images were formed with a laser printer using a dry toner as described below, desensitization treatment was carried out to make a printing plate and printing was conducted. The results obtained are shown in Table 1 below.

TABLE 1

| | Example 1 | Comparative Example 1 | Comparative Example 2 | Comparative Example 3 | Comparative Example 4 |
|---|---|---|---|---|---|
| Properties of image-receiving layer | | | | | |
| Smoothness *1) (sec/10 cc) | 52 | 55 | 50 | 48 | 50 |
| Three dimensional surface roughness Ra (μm)/λa (μm) *2) | 1.58/38.5 | 1.61/43.0 | 1.71/42.3 | 1.80/81.3 | 2.25/93.0 |
| Image on Plate Precursor | | | | | |
| Image quality *3) | A good | B a slight unevenness in screen tint area | B a slight unevenness in screen tint area | C many white spots in solid area (solid area is not uniform) | C many white spots in solid area (solid area is not uniform) |
| Fog in non-image area | A little fog of toner | A little fog of toner | A little fog of toner | B a little fog of toner | B a little fog of toner |
| Printed image | | | | | |
| Image quality *4) | A good | B a little white spot in solid area | B a little white spot in solid area | C many white spots in solid area | C many white spots in solid area |
| Fog in non-image area | good | good | good | a little stain | a little stain |
| Press life *5) | 3,000 sheets | uneven white spots were generated in solid area from the start of printing | uneven white spots were generated in solid area from the start of printing | fog was generated in background from the start of printing, white spots were generated in solid area | fog was generated in background from the start of printing, white spots were generated in solid area |

Items of evaluation shown in Table 1 are as follows.

*1) Smoothness of Image-receiving Layer

Smoothness (sec./10 cc) of the printing plate precursor was measured using a Bekk smoothness tester (a product of Kumagaya Riko K.K.) on condition of air capacity of 10 cc.

*2) Three Dimensional Surface Roughness

Three dimensional surface roughness of the printing plate precursor was measured using a three dimensional surface roughness measuring device (SE-3FK, trade name, a product of Kosaka Laboratory Ltd.) and a three dimensional surface roughness analyzer (SPA-11, trade name, a product of Kosaka Laboratory Ltd.) on the following condition.

Measuring Condition:

Measuring length X-axis: 2.5 mm, Y-axis: 0.4 mm

Axis sampling pitch: 0.05 μm

Inclined adjustment, no cut-off.

Measured Value:

Average surface center roughness: SRa (μm)

Average wavelength: Sλa (μm)

These measurements were performed according to the standard of ISO-468. In detail, a reference can be made, for example, to Jiro Nara, "Hyomen-Arasa no Sokutei·Hyokahou (Measurement and Evaluation of Surface Roughness)", Sogou Gijutsu Center (1983).

*3) Quality of Image on Printing Plate Precursor

The copied image obtained from the printing plate precursor with a laser printer (AMSIS 1200-J Plate Setter, trade name) using a dry toner commercially available as AM-Straight Imaging System was visually evaluated by a magnifier of 20 magnifications.

*4) Quality of Printed Image

An image was formed on the printing plate precursor in the same manner as *3). A desensitization treating solution (SICS, trade name, produced by Nippon AM Co.) was placed in the etcher area of an automatic printer (AM-2850, trade name, produced by AM Co.), as a fountain solution, a solution obtained by diluting the desensitization treating solution (SICS) with distilled water to 4 times was placed in the pan for a fountain solution, and printing was conducted by feeding the printing plate having an image to the printer using a black ink for offset printing. The printed image on the tenth printed sheet was visually evaluated by a magnifier of 20 magnifications (fog in the background, the uniformity of screen tint area, the uniformity of the solid area of the image area).

*5) Press Life

Printing was conducted in the same manner as in *4), and the number of sheets were counted until the background stain or the defect of the image could be visually discriminated.

As shown in Table 1, the Bekk smoothness of image-receiving layers of each printing plate precursor provided on the same support was adjusted to almost the same value.

The surface roughness of each printing plate precursor was examined by three dimensional surface roughness and SEM photograph. From each value of center average roughness SRa representing the size of surface concavity and convexity and average wavelength Sλa representing the criterion of the distance between concavity and convexity, the printing plate precursor of the present invention and those of Comparative Examples 1 and 2 were almost the same concerning SRa, and different a little concerning Sλa. Further, as a result of examining convexities having the height of 50 μm or more, there were 3 to 4/cm$^2$ in the present invention, on the contrary, in Comparative Examples 1 and 2, 50 to 60/cm$^2$. Therefore, concavities and convexities in the present invention were uniform in size and distributed densely.

Comparative Examples 3 and 4 in which Compound (P-1) having a chelating capability was excluded showed the surface states in which the rough grains were distributed scatteredly.

Then, image was formed on a printing plate precursor, the surface was desensitized, and offset printing was conducted. As a result, only the printing plate precursor of the present invention provided images having good quality on both the plate precursor and the printed matter. That is, in the copied image of the present invention obtained by dry toner transfer from the laser printer, there were no defects of fine lines, fine characters, and screen tint area, solid areas were uniform, unevenness of toner transfer was not observed, background fog in the non-image area due to scattering of the toner was little and there was no problem in practical use.

On the other hand, in Comparative Examples 3 and 4 in which Compound (P-1) was excluded, white spots in the solid area were conspicuous and background fog was extremely generated in the non-image area, therefore, they were impracticable.

Each of the images formed on the precursors in Comparative Example 1 in which Compounds (A-1) and (P-1) were present simultaneously and wet dispersed and Comparative Example 2 in which Compounds (A-1) was excluded in the first dispersion was practicable with respect to background fog in the non-image area similar to that of the present invention but had the generation of unevenness in the screen tint area of the image area, making the precursor impracticable.

Then, the image formed was desensitized to prepare a printing plate, and the performance was evaluated in terms of the printed matters obtained using the printing plate. As a result, only the printing plate of the present invention provided good image with no defects of fine lines, fine characters and screen tint area, and no unevenness in the solid area, and provided 3,000 or more good printed sheets without printing smearing due to ink. On the contrary, in Comparative Examples 1 to 4, background stain in the non-image area and unevenness in the image area were generated from the start of printing.

From these results, properties of the image-receiving layer originated in the zinc oxide grains used and the quality of images on the printing plate and the printed matter are thought to be closely related. That is, this is presumably due to the fact that the size distribution of the grain contained in the image-receiving layer of the present invention is comparatively uniform and the surface having concavity and convexity densely can be obtained.

Comparing the precursor of the present invention with those of Comparative Examples 3 and 4, it can be seen that the Bekk smoothness is almost the same, the three dimensional surface roughness, the surface concavity and convexity of the printing plate precursor of the present invention are formed extremely densely. Further, the stained background of the non-image area on the plate precursor having an image was observed with an optical microscope of 200 magnifications. The number of scattered toner area, which was the background stain, was 15 per unit area (1 mm$^2$) in the precursors of both the present invention and Comparative Examples 3 and 4. But with respect to the number of those having a scattered size of 15 μm or more, the precursor of the present invention had 0 or 1, while each comparative example had 4 or 5.

From the above, it is thought that when the plate making from the printing plate precursor of the present invention was conducted, adhesion of scattered toner to the non-image area was prevented, fattening of toner grains in the fixing treatment by a heat roller was prevented, and this largely affected the background stain by visual observation. Further, the difference between the background stain of the printed matters of Example 1 and Comparative Examples 3 and 4 corresponds to the size of the scattered toner on the above-made printing plate. The scattered toner of a small size of 15 μm or less becomes hydrophilic at desensitizing treatment but the toner of a coarse size remains and causes printing smearing due to ink.

As described above, there was not such a large difference with respect to SRa and Sλa in the three dimensional surface roughness but the presence of the convexities of 50 μm or more per unit area (cm$^2$) was a large difference between Comparative Examples 1 and 2 and the present invention.

This is thought to be the cause which prevents transfer of the toner to the printing plate precursor, adhesion and fixation to and on the fine image area such as screen tint area and generates unevenness of the image.

Thus, only the printing plate precursor of the present invention can provide excellent printed matters.

EXAMPLE 2

An underlayer (surface resistivity: $4\times10^{10}\Omega$) having a dry coating amount of 10 g/m$^2$ was provided on a substrate of high quality paper weighing 100 g/m$^2$ by coating a coating solution for the underlayer having the composition shown below on one side of the substrate by a wire bar coater. The smoothness of the surface of the underlayer was 150 sec./10 cc. The smoothness was adjusted by calendering to 1,500 sec./10 cc.

| Coating Solution for Underlayer | |
|---|---|
| Carbon black | 10 parts by weight |
| SBR latex (50 wt % water dispersion solution, Tg: 25° C.) | 92 parts by weight |
| Clay (45 wt % water dispersion solution) | 110 parts by weight |
| Melamine (aqueous solution of 80 wt %) | 5 parts by weight |
| Water | 191 parts by weight |

Further, a back coat layer (surface resistivity: $5\times10^7\Omega$) having a dry coating amount of 12 g/m$^2$ was provided by coating a coating solution for the back coat layer having the composition shown below on the other side of the substrate by a wire bar coater. Calendering treatment was conducted by setting the calender condition such that the smoothness of the surface of the back coat layer became 50 sec./10 cc.

| Coating Solution for Back Coat Layer | |
|---|---|
| Kaolin (50 wt % water dispersion solution) | 200 parts by weight |
| Aqueous solution of polyvinyl alcohol (10%) | 60 parts by weight |
| SBR latex (solid area: 49%, Tg: 0° C.) | 100 parts by weight |
| Precondensate of melamine resin (solid area: 80%, Sumirez Resin SR-613) | 5 parts by weight |

On the underlayer of the thus-produced support, the coating solution for the image-receiving layer used in Example 1 was coated with a wire bar coater, dried at 100° C. for 1 minute to form an image-receiving layer having a coating amount of 8 g/m$^2$ and a direct drawing type lithographic printing plate precursor was obtained.

Image was formed on the thus-obtained printing plate precursor in the same manner as in Example 1. The background stain by scattered toner of the non-image area of the obtained plate was good and comparable to that in Example 1 (grade: A) and fine lines, fine characters and screen tint area in the image area were reproduced more sharp and the uniformity in the solid area was superior to that in Example 1. Printed matters of 3,000 sheets or more could be obtained using the desensitization treated printing plate, which were the same level as the image formed on the plate precursor.

Image formation was conducted using the printing plate precursors of Examples 1 and 2 with a laser printer AMSIS 1200J Plate Setter by changing the adhesion amount of the dry toner from 9 g to 7 g/m$^2$. With respect to the image-formed plate precursor of Example 2, in which the surface of the support on which the image-receiving layer was provided had high smooth surface, the background stain of the non-image area and the reproducibility of the image area were excellent, completely the same as in the case where the adhesion amount of the dry toner was 9 g/m$^2$. On the other hand, with respect to the image-formed plate precursor of Example 1, the background stain was excellent and the same as in the case where the adhesion amount of the dry toner was 9 g/m$^2$, but a little unevenness was observed in the image of the screen tint area.

From the above, by providing the image-receiving layer on a high smooth support according to the present invention, reproduction of more sharp image is feasible and the image-formed plate and printed matters of stable quality can be obtained irrespective of the printer conditions.

EXAMPLES 3 TO 11

A mixture of 100 g of dry zinc oxide (SAZEX-2000, produced by Sakai Chemical Industry Co., Ltd.), 13.6 g of binder resin (B-3), 2.4 g of binder resin (B-4) each having the structure shown below, $1.4\times10^{-3}$ mol of Compound (A) shown in Table 2, 30 g of methanol and 120 g of toluene was dispersed using Keddy Mill KDM-7-4 type at a rotating rate of $1.5\times10^4$ rpm for 20 minutes. Subsequently, a mixed solution of $5.0\times10^{-4}$ mol of Compound (P) shown in Table 2 was added to the above dispersion at a rotating rate of $2\times10^3$ rpm over 10 minutes. The above reaction mixture was further dispersed at a rotating rate of $5\times10^3$ rpm over 20 minutes. Thus, a dispersion for an image-receiving layer was obtained.

Binder Resin (B-3)

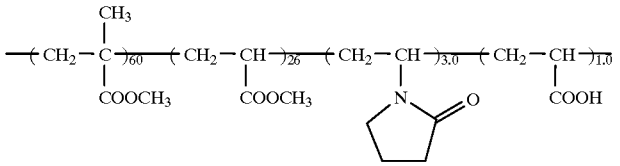

Mw $5\times10^4$ (ratio by weight)

Binder Resin (B-4)

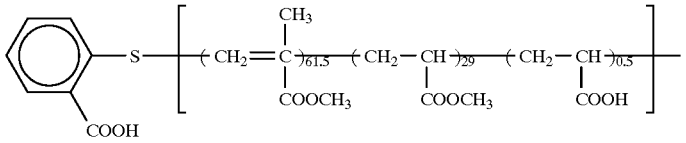

Mw $8\times10^3$ (ratio by weight)

Each coating solution was coated on the water-resistant support used in Example 2 with a wire bar coater such that the coating amount reached 10 g/m$^2$ and dried to obtain a direct drawing type lithographic printing plate precursor. The Bekk smoothness of the surface of each printing plate precursor was from 45 to 60 (sec./10 cc).

TABLE 2

| Example | Compound (A) | Compound (P) |
|---|---|---|
| 3 | [A-2]<br>2,6-Dimethoxybenzoic acid | [P-2]<br>$HO(CH_2)_2$<br>$N(CH_2)_2N(CH_2PO_3H_2)_2$<br>$(PO_3H_2)CH_2$ |
| 4 | [A-3]<br>1-Naphthylacetic acid | [P-3]<br>$(CH_2PO_3H_2)_2NCH_2$ — 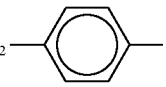 — $CH_2N(CH_2PO_3H_2)_2$ |
| 5 | [A-4]<br>4-N,N-Dimethylaminobenzoic acid | |
| 6 | [A-5]<br>3-Methoxycyclohexane carboxylic acid | [P-5]<br>$(CH_2OPO_3H_2)_2N$ — 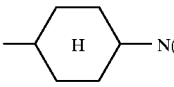 — $N(CH_2OPO_3H_2)_2$ |
| 7 | [A-6]<br>2-Norborneneacetic acid | [P-6]<br>$CH_2PO_3H_2$<br>$(PO_3H_2)CH_2$<br>N<br>N<br>N — $CH_2PO_3H_2$<br>N<br>$(PO_3H_2)CH_2$<br>N<br>$CH_2PO_3H_2$ |
| 8 | [A-7]<br>$H_3COOC(CH_2)_2S(CH_2)_2COOH$ | [P-7]<br>$(OPO_3H_2)CH_2$ — N<br>N — $CH_2OP_3H_2$ |
| 9 | [A-8]<br>$C_2H_5S(CH_2)_2COO(CH_2)_2OPO_3H_2$ | [P-8]<br>$(CH_2PO_3H_2)_2N(CH_2)_3O(CH_2CH_2O)_2(CH_2)_3N(CH_2PO_3H_2)_2$ |
| 10 | [A-9]<br>$CH_3S(CH_2)_2COO(CH_2)_2SO_3H$ | [P-9]<br>COOH<br>$(CH_2PO_3H_2)_2N(CH_2)_3CHN(CH_2PO_3H_2)_2$ |
| 11 | [A-10]<br>HOOC — $(CH_2)S$ — 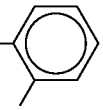 <br>COOH | [P-10]<br>$H_2O_3PCH_2N[(CH_2)_3N(CH_2PO_3H_2)_2]_2$ |

Image was formed using each printing plate precursor in the same manner as in Example 1, desensitization treatment was conducted to make a printing plate and offset printing was conducted.

The obtained printed matters provided excellent sharp image quality with no stain in the non-image area, which were the same as in Example 2, and the press life was 3,000 sheets or more and excellent.

EXAMPLE 12

A mixture of 100 g of dry zinc oxide (produced by Seido Kagaku Kogyo K.K.), 14 g of binder resin (B-5) having the structure shown below, 1.5 g (as solid area) of acrylic resin grain dispersion, 0.20 g of m-toluylic acid (A-11), and 230 g of toluene was dispersed with 200 g of glass beads having grain sizes of from 0.7 to 1 mm in Dyno Mill disperser (Shin Maru Enterprise Co.) at a rotating rate of $5\times10^3$ rpm for 10 minutes. An aqueous solution of 4.2 g of water containing 1.8 g of Compound (P-11) having the following structure was added to the above dispersion and further dispersed at a rotating rate of $1.5\times10^3$ rpm for 5 minutes. Then, glass beads were filtrated to obtain a coating solution for an image-receiving layer.

The Bekk smoothness of the surface of the obtained image-receiving layer was 50 (sec./10 cc).

Image was formed on this printing plate precursor in the same manner as in Example 1, desensitization treatment was conducted to make a printing plate and offset printing was conducted.

The obtained printed matters provided excellent sharp image quality with no stain in the non-image area, similarly to that in Example 2, and the press life was 3,000 sheets or more and excellent.

In the image formed on the precursor with a heat-sensitive transfer type printer (Write Movell, trade name, a product of Kanto Denshi K.K.), ink transfer from the ink ribbon to the non-image area was hardly observed and was practically negligible degree.

Further, the plate precursor having the image was desensitization treated using SICS desensitizing solution to make a printing plate, and offset printing was conducted. The obtained printed matters provided little stain in the non-image area and was negligible degree, and defects of fine lines and fine characters were not observed in the image area. 1,000 sheets or more of good printed matters were obtained.

Binder Resin (B-5)

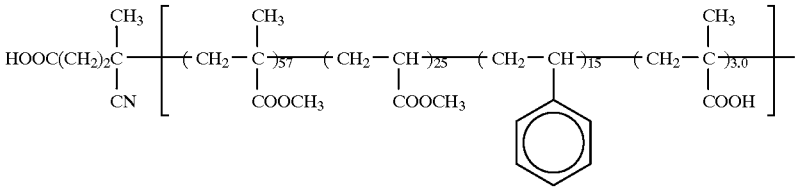

Mw: $5\times10^4$ (ration by weight)

Dispersion of Acrylic Resin Grains

A mixture of 8 g of acrylic acid, 2 g of AA-6 (trade name, produced by Toagosei Chemical Industry Co., LTD., macromonomer of methyl methacrylate), 2 g of ethylene glycol dimethacrylate, 0.1 g of methyl 3-mercaptopropionate and 55 g of methyl ethyl ketone was heated to 60° C. in the nitrogen atmosphere. 0.2 g of 2,2'-azobis(isovaleronitrile) was added to the above reaction mixture and allowed to react for 3 hours, then 0.1 g of the above initiator was further added and allowed to react for further 4 hours. The reactivity was 95%. The obtained dispersion was an excellent monodisperse dispersion with the average grain size of the dispersed resin grains being 0.20 μm (grain size was measured by CAPA-500, trade name, a product of Horiba, Ltd.).

Compound (P-11)

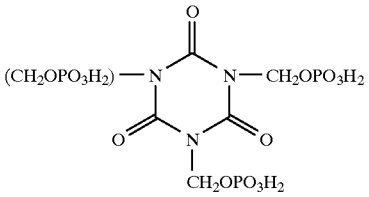

This dispersion was coated on the same water-resistant support as used in Example 2 using a wire bar coater such that the coating amount reached 9 g/m$^2$ and dried to obtain a direct drawing type lithographic printing plate precursor.

EXAMPLE 13

Preparation of Water-resistant Support 20 g/m$^2$ of a 5% aqueous solution of calcium chloride was coated on high quality paper weighing 95 g/m$^2$ and dried to obtain a conductive raw paper. Aqueous latex of an ethylene/methyl acrylate/acrylic acid copolymer (65/30/5 by molar ratio) was coated on both surfaces of the above support such that the dry coating amount reached 0.2 g/m$^2$ and dried. Pellets obtained by heat melting and mixing 70% of low density polyethylene having density: 0.920 g/cc, melt index: 5.0 g/10 min., 1.5% of high density polyethylene having density: 0.950 g/cc, melt index: 8.0 g/10 min., and 15% of conductive carbon was extruded on one side of the above support to provide a uniform polyethylene layer (surface resistivity: $6\times10^9\Omega$) having a thickness of 25 μm. Then, the smoothness was adjusted to 2000 (sec./10 cc) by calendering treatment.

Further, a back coat layer (surface resistivity: $8\times10^7\Omega$) having a dry coating amount of 20 g/m$^2$ was provided by coating a coating solution for the back coat layer having the composition shown below on the other side of the substrate by a wire bar coater. Calendering treatment was conducted by setting the calender condition such that the smoothness of the surface of the back coat layer became 450 sec./10 cc.

| Coating Solution for Back Coat Layer | |
|---|---|
| Clay (50% water dispersion solution) | 200 parts by weight |
| Oxidized starch (20% aqueous solution) | 40 parts by weight |
| SBR latex (solid area: 49%, Tg: 10° C.) | 150 parts by weight |
| Precondensate of melamine resin (solid area: 80%, Sumirez Resin SR-613) | 10 parts by weight |

Subsequently, the surface of the polyethylene layer was corona discharge treated at 5 KVA·sec/$m^2$ and a coating solution for an image-receiving layer having the following composition was coated thereon to reach the dry coating amount of 8 g/$m^2$ and dried to provide an image-receiving layer. The Bekk smoothness of the surface of the image-receiving layer was 50 (sec./10 cc).

Preparation of Printing Plate Precursor

A mixture of 100 g of dry zinc oxide (produced by Seido Chemical Co.), 14.4 g of binder resin (B-6), 1.6 g of binder resin (B-7) each having the structure shown below, 0.36 g of 3-propoxybenzoic acid (A-12) and 155 g of toluene was dispersed using Keddy Mill at a rotating rate of $1\times10^4$ rpm for 20 minutes. Subsequently, a mixed solution of 2.3 g Compound (P-12) having the following structure, 4 g of water and 2 g of methanol was dropwise added to the above dispersion at a rotating rate of $1\times10^3$ rpm over 5 minutes. The above reaction mixture was further dispersed at a rotating rate of $5\times10^3$ rpm for 15 minutes to obtain a dispersion for an image-receiving layer.

This dispersion was coated on the above water-resistant support using a wire bar coater such that the coating amount reached 8 g/$m^2$ and dried to obtain a direct drawing type lithographic printing plate precursor.

Image was formed on this printing plate precursor in the same manner as in Example 1, desensitization treatment was conducted to make a printing plate and offset printing was conducted.

The obtained printed matters provided excellent sharp image quality with no stain in the non-image area, similar to that in Example 2 and the press life was 5,000 sheets or more and excellent.

In the image formed on the precursor with a heat-sensitive transfer type printer (Write Movell, trade name, a product of Kanto Denshi Co.), ink transfer from the ink ribbon to the non-image area was hardly observed and was practically negligible degree.

Further, the plate precursor was desensitization treated using SICS desensitizing solution to make a printing plate, and offset printing was conducted. The obtained printed matters provided little stain in the non-image area and was negligible degree, and defects of fine lines and fine characters were not observed in the image area and 1,000 sheets or more of good printed matters were obtained.

EXAMPLES 14 TO 25

A direct drawing type lithographic printing plate precursors were produced in the same manner as in Example 12 that Compound (A-12) was replaced with each compound in Table 3 below in an amount of $1.0\times10^{-3}$ mol.

Binder Resin (B-6)

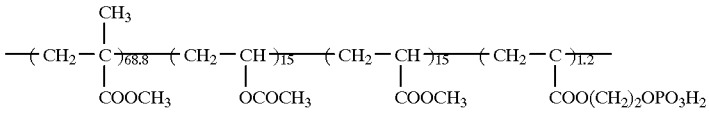

Mw $5\times10^4$ (ratio by weight)

Binder Resin (B-7)

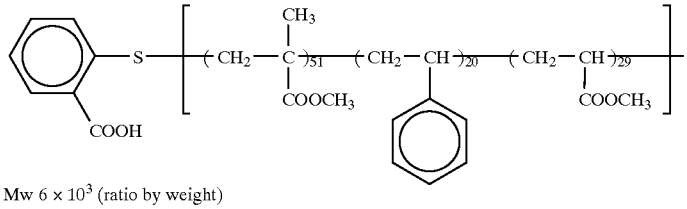

Mw $6\times10^3$ (ratio by weight)

Compound (P-12)

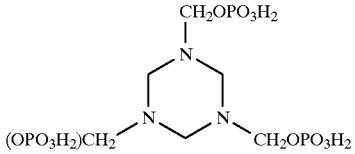

TABLE 3

| Example | Compound (A) |
|---|---|
| 14 | (A-13): 3-Ethoxypropionic acid |
| 15 | (A-14): Phenoxyacetic acid |
| 16 | (A-16): Crotonic acid |
| 17 | (A-17): 2,4,6-Trimethoxybenzoic acid |
| 18 | (A-18): 2,6-Dichlorobenzoic acid |
| 19 | (A-19): Succinic acid monomethyl ester |
| 20 | (A-20): 2-Chloromaleic acid monoethyl ester |
| 21 | (A-21): 3-Piperidinopropionic acid |
| 22 | (A-22): 4-(2-Methoxycarbonyl)ethylthioxy benzoic acid |
| 23 | (A-23): n-Heptanecarboxylic acid |
| 24 | (A-24): Anthraquinone-β-carboxylic acid |
| 25 | (A-25): 4-Methoxybenzenephosphonic acid |

Image was formed on this printing plate precursor in the manner as in Example 12, desensitization treatment was conducted to make a printing plate and offset printing was conducted.

The obtained printed matters provided excellent sharp image quality with no stain in the non-image area, similar to that in Example 12, and the press life was 3,000 sheets or more and excellent.

Further, image was formed on this printing plate precursor in the same manner as in Example 2 using a heat-sensitive printer to make a printing plate and printing was conducted. The obtained printed matters provided no stain in the non-image area. 1,000 sheets or more of good printed matters were obtained.

The direct drawing type lithographic printing plate precursor of the present invention as a plate precursor for offset printing exhibits excellent desensitization such that not only wholly generated or dot-like background stain but also unevenness in the screen tint area or solid area are not caused. Also, by direct drawing type by electrostatic transfer system using an electrophotographic copier, printed matters of sharp image free of printing smearing in the screen tint area or in the solid area can be obtained.

While the invention has been described in detail and with reference to specific examples thereof, it will be apparent to one skilled in the art that various changes and modifications can be made therein without departing from the spirit and scope thereof.

What is claimed is:

1. A direct drawing lithographic printing plate precursor comprising a water-resistant support having provided thereon an image-receiving layer, wherein said image-receiving layer is formed by film coating a dispersion prepared by:

wet dispersion processing, with a dispersion medium of a nonaqueous solvent, a mixture comprising at least one zinc oxide dispersed in the presence of water, a binder resin and an organic compound, Compound (A), which is soluble in said dispersion medium and contains at least one acid group selected from the group consisting of $—CO_2H$, $—SO_3H$ and $—PO_3H_2$, Compound (A) being able to form a chelate compound with the zinc oxide or a zinc ion formed from the zinc oxide, then adding a water-soluble low molecular weight organic compound, Compound (P), containing at least two or more $—PO_3H_2$ groups, which forms a chelate compound with the zinc oxide or the zinc ion, and further effecting wet dispersion processing.

2. The direct drawing lithographic printing plate precursor of claim 1, wherein Compound (A) is contained in an amount of from $1\times10^{-5}$ to $1\times10^{-2}$ mol per 100 g of the zinc oxide and Compound (P) is contained in an amount of $1\times10^{-4}$ to $1\times10^{-1}$ mol per 100 g of the zinc oxide.

3. The direct drawing lithographic printing plate precursor of claim 1, wherein the surface of the side of the support adjacent to the image-receiving layer has a Bekk smoothness of 900 to 3,000 (seconds per 10 cc.).

4. The direct drawing type lithographic printing plate precursor of claim 2, wherein the surface of the side of the support adjacent to the image-receiving layer has a Bekk smoothness of 900 to 3,000 (second per 10 cc).

* * * * *